US005120039A

United States Patent [19]

Yamada

[11] Patent Number: 5,120,039

[45] Date of Patent: Jun. 9, 1992

[54] SHEET SORTER WITH GUIDE MOVING DEVICE AND SEPARATE MOVING DEVICE FOR FEEDING MEANS MOUNTED ON END OF GUIDE

[75] Inventor: Yasushi Yamada, Tokyo, Japan

[73] Assignee: Konica Corporation, Tokyo, Japan

[21] Appl. No.: 580,670

[22] Filed: Sep. 11, 1990

[30] Foreign Application Priority Data

Sep. 20, 1989 [JP] Japan ..... 1-246020
Oct. 6, 1989 [JP] Japan ..... 1-261741

[51] Int. Cl.[5] ..... G03G 21/00

[52] U.S. Cl. ..... 271/4; 271/6; 271/7; 355/308; 355/316; 355/317

[58] Field of Search ..... 271/3, 3.1, 4, 6, 7, 271/306, 314; 355/308, 317, 316, 320

[56] References Cited

U.S. PATENT DOCUMENTS 4,912,518 3/1990 Matsuo et al. ..... 355/321 X 4,975,749 12/1990 Tsunoda et al. ..... 355/321 X

*Primary Examiner*—A. T. Grimley
*Assistant Examiner*—J. E. Barlow, Jr.
*Attorney, Agent, or Firm*—Finnegan, Henderson, Farabow, Garrett and Dunner

[57] ABSTRACT

An apparatus for feeding a document includes a platen where a document is subjected to copy operation; a feeding device for feeding a document onto the platen; a delivering device for delivering a document from the platen; a conveying device for conveying a document on the platen to the delivering device; the delivering device driven independently of the conveying device; and a control device for controlling operation timings of the feeding device, the conveying device and the delivery device, wherein the control device stops the conveying device when the trailing end of a document being delivered by the delivering device has been located between the conveying device and the delivering device.

9 Claims, 4 Drawing Sheets

SHEET SORTER WITH GUIDE MOVING DEVICE AND SEPARATE MOVING DEVICE FOR FEEDING MEANS MOUNTED ON END OF GUIDE

BACKGROUND OF THE INVENTION

This invention relates to an automatic document feeder of a copier and the like and more particularly to an automatic document feeder in which documents stacked on a document tray are conveyed onto a platen glass one sheet by one sheet and delivered out to a document delivery unit after exposure.

In a conventional automatic document feeder, a document delivery out means such as a document delivery roller is driven by the drive force transmitted from a document feed conveyance means located on a platen glass in such a manner that: the document delivery out means and the document feed conveyance means are connected by a timing belt so that the delivery out means can be driven by the conveyance means. In the case of the document feeder described above, the document feed conveyance means on the platen glass needs to be driven until the document is delivered out from the document delivery means. As a result, it has such disadvantages that: the consumption of electric power is increased, so that the document feed conveyance means on the platen glass and the like are worn out fast, and furthermore the interval between the document delivered out from on the platen glass and the following document conveyed onto the platen glass needs to be kept longer than the distance between the conveyance means and the delivery out means. For that reason, there is a problem that it takes a long period of time to replace a document at an exposure position, so that the processing speed of the document feeder is decreased.

The object of the present invention is to solve the problems described above. The first object of the present invention is to provide an automatic document feeder which is characterized in that: the document feed conveyance means on the platen glass can be stopped before the document is delivered out by the delivery means; the interval between the document to be delivered out and the document to be fed for replacing the document at the exposure position, can be made shorter than the distance between the conveyance means and the delivery out means; the consumption of electric power can be reduced and the conveyance means and the like are less worn out; and further the total document processing time can be reduced.

In the conventional automatic document feeder described above, document feed is conducted in such a manner that: the conveyance means located on the platen glass further conveys the document which has been fed by a document feed means until the leading edge of the document comes into contact with the stopper at the end of the platen glass so that the document can be positioned on the platen glass; and when the document is delivered out from the platen glass to the delivery conveyance means, the document is conveyed passing through the platen glass, so that the document conveyance direction by the document feed conveyance means located on the platen glass is one way. For the reason explained above, there is a problem in the conventional automatic document feeder, that when the document on the platen glass is delivered out, the stopper at the end of the platen glass needs to be withdrawn so that the stopper does not obstruct document conveyance.

In order to solve the problem described above, the second object of the present invention is to provide an automatic document feeder which is characterized in that: when the document located on the platen glass is delivered out, it is not necessary to withdraw the stopper at the exposure position.

SUMMARY OF THE INVENTION

The automatic document feeder to accomplish the first object of the present invention is composed in such a manner that: the conveyance means located on the platen glass and the delivery out means which delivers out the document sent from the platen glass by the above-described conveyance means, can be independently driven; the above-described conveyance means is stopped by a control unit while the trailing part of the document is interlocated between the above-described conveyance means and the delivery out means; and the delivery out means is stopped by the control unit after the trailing end of the document has passed through the above-described delivery out means.

The automatic document feeder of the present invention, the composition of which has been explained above, can be operated in such a manner that: in order to quickly replace the document placed on the platen glass, the interval between the document to be delivered out and the document to be fed, is reduced; and when a document to be exposed has reached the exposure position, the previous document can be continuously conveyed by the delivery out means until it is delivered out, wherein the delivery out means is driven even after the previous document has been sent out from the conveyance means. As a result, the total document conveyance time can be reduced, and further the electric power can be economized and the wear of the conveyance means can be reduced since the document feed conveyance means is stopped earlier than the conventional document feeder.

In the automatic document feeder which accomplishes the second object of the present invention, the document conveyance operation is conducted as follows. The document conveyance means sends out documents stacked on a document tray to the document feed conveyance means located on the platen one sheet by one sheet. The document feed conveyance means on the platen stops the document at a standard stop position on the platen glass which is located on the trailing edge side of the document, and a predetermined exposure is conducted on the document. Then, the following document is sent onto the platen glass by the above-described document conveyance means, and at the same time the previous document located at the above-described standard stop position, is conveyed to the delivery means by the document feed conveyance means on the platen, and then the document delivery means delivers the conveyed document to the document delivery portion. The conveyance distance between the leading edge of a document which is sent from the document conveyance means to the document feed conveyance means located on the platen and the above-described standard document stop position, is set longer than the conveyance distance between the leading edge of the document located at the standard stop position and the delivery conveyance means, and set shorter than the distance between the trailing end of the document located on the standard stop position and the document delivery means. The delivery conveyance means can be driven even when the document feed conveyance means located on the platen is stopped.

In the automatic document feeder of the present invention, the document is conveyed to the standard stop position on the platen glass by the document feed conveyance means in order to be exposed, and after that the exposed document is conveyed to the delivery conveyance means. Accordingly, any document can not pass through the exposure position not to be exposed, and when the stopper like this is provided to the standard stop position, the stopper withdrawal means can be eliminated. When a plurality of documents are stacked on the document stack unit, the conveyance distance between the leading edge of a document which is sent from the document conveyance means to the document feed conveyance means located on the platen, and the above-described document stop standard position, is set longer than the conveyance distance between the leading edge of the document located at the standard stop position and the delivery conveyance means, and set shorter than the distance between the trailing end of the document located on the standard stop position and the document delivery means. When document feeding to the platen by the document conveyance means and delivery out of an exposed document by the document conveyance means located on the platen are simultaneously conducted and the following document has reached the exposure position, the leading edge of the previous document reaches the delivery out means and the trailing end of the previous document is already discharged from the document conveyance means on the platen, so that the drive of the document feed conveyance means located on the platen can be stopped to place the following document at the while the delivery out means is kept driving in order to deliver out the exposed document to the document delivery unit. In this way, the processing speed of the whole documents on the document stack can be increased.

PREFERRED EMBODIMENT OF THE INVENTION

Figure 1:
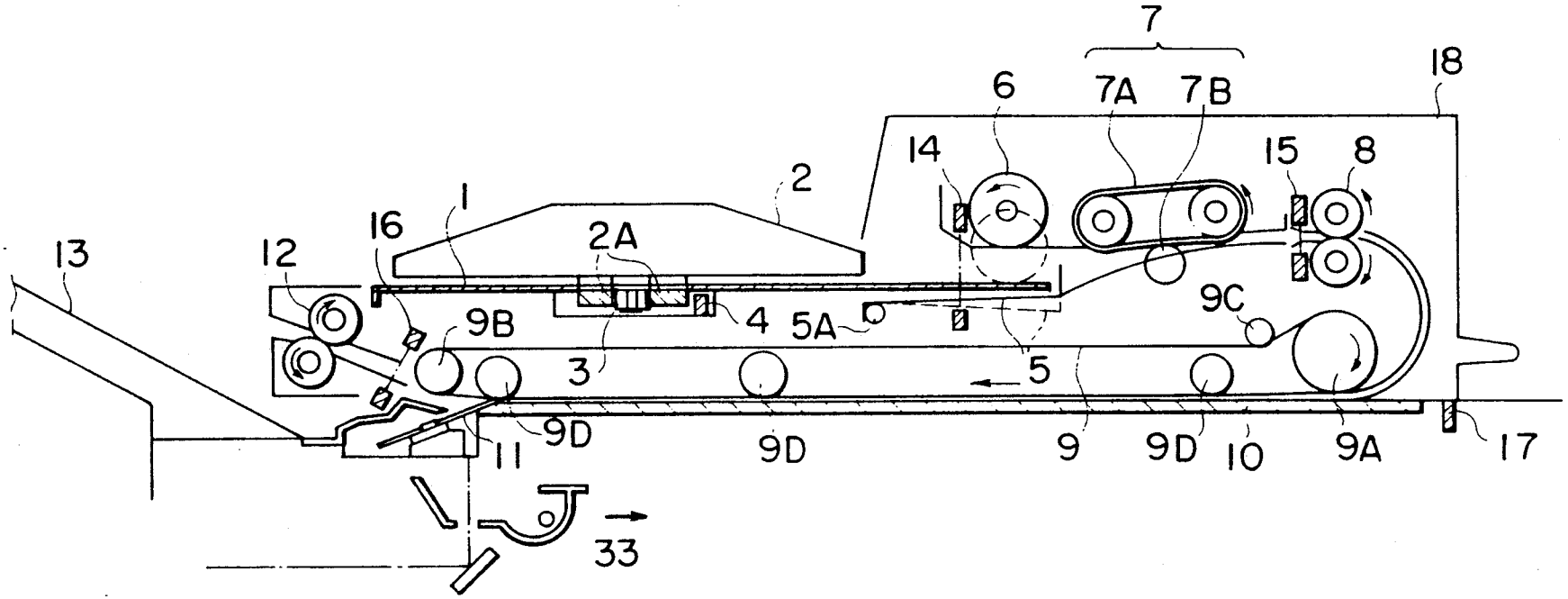
FIG. 1 is a sectional side view of the main portion of the automatic document feeder of the present invention to attain the first object of the invention.

Referring now to the drawings, the automatic document feeder of the present invention will be explained as follows.

Figure 2:
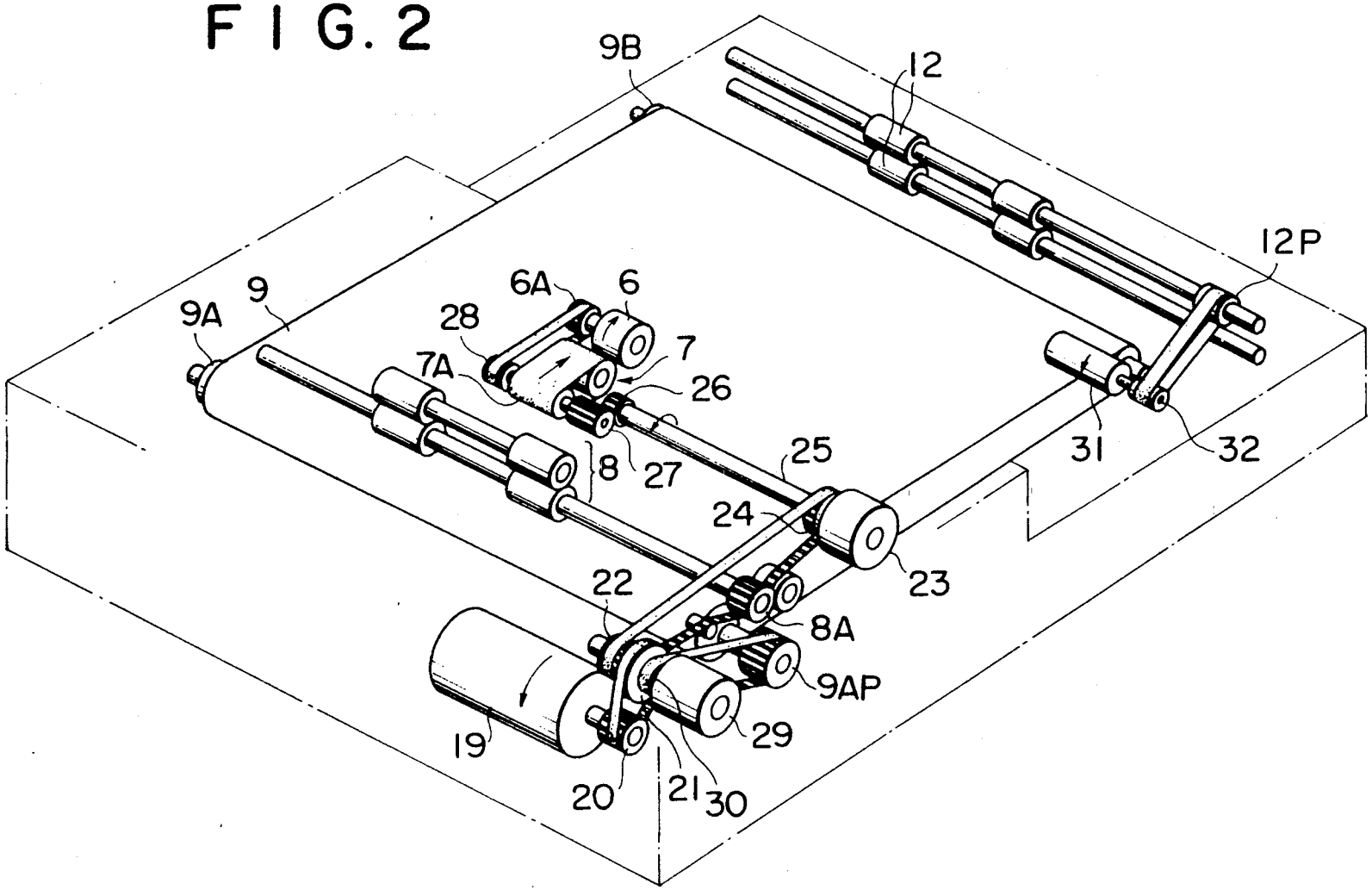
FIG. 2 is a partial perspective view of the drive mechanism of the automatic document feeder of the present invention to attain the first object of the invention.

FIG. 1 is a sectional side view of the main portion of the automatic document feeder of the present invention to attain the first object of the invention, and FIG. 2 is a perspective view of the drive mechanism of the automatic document feeder to attaint the first object of the present invention.

In FIG. 1, the numeral 1 is a document stack unit, and the numeral 2 is a pair of side position regulating plates which are composed in such a manner that: the racks 2A are provided to the lower portions of the document stack unit 1; and both racks are engaged through the pinions 3 so that the plates can be symmetrically moved. The numeral 4 is a document size sensor which gets the information about the document size by detecting the position of the rack 2A. The numeral 5 is a document leading edge regulating plate which arranges the leading edge of the documents stacked on the document stack unit 1. The numeral 6 is a document feed roller which comes into contact with the upper surface of the document stacked on the document stack unit 1, and which is rotated in the direction of an arrow so that the uppermost document can be sent out by the frictional force. When the feed roller 6 is displaced its position from the position illustrated by a solid line to the position illustrated by a broken line, the document leading edge position regulating plate 5 is also displaced from the position illustrated by a solid line to the position illustrated by a broken line so that the document leading edge position regulating plate 5 can not obstruct the document feeding, wherein the rotation of the regulating plate 5 around the supporting shaft 5A is checked by a stopper not illustrated in FIG. 1.

The numeral 7 is a document separating means comprising the conveyance belt 7A which is rotated in the direction of an arrow and the separation roller 7B which is stationary or rotated counterclockwise at a slow speed, wherein the separation roller 7B comes into contact with the belt surface with light pressure. The numeral 8 is a pair of relay rollers which further convey a document sent by the separation means 7. The numeral 9 is a conveyance belt on the platen which is rotated in the direction of an arrow when a document is conveyed onto the platen glass 10 and delivered out from the platen glass to the document delivery unit 13 through the delivery roller 12. The numerals 9A and 9B are a drive roller and an idle roller by which the conveyance belt on the platen 9 is stretched. The numeral 9C is a tension roller for the conveyance belt on the platen 9. The numeral 9D is a press roller which presses the conveyance belt 9 on the platen against the upper surface of the platen glass 10.

The numeral 11 is a stopper which is activated in such a manner that: when a document is set on the platen glass 10, the upper portion of the stopper 11 is protruded from the upper surface of the platen glass 10 as illustrated in the drawing so that the protruded portion can check the document conveyance; and when the document is delivered out from the exposure position to the document delivery unit 13, the upper portion of the stopper is withdrawn to a withdrawal position from the upper surface of the platen glass 10. The displacement of the stopper 11 is conducted in such a manner that: the stopper is withdrawn to the withdrawal position just before the conveyance belt on the platen 9 is rotated; and it is protruded from the upper surface of the platen glass 10 just before the conveyance belt on the platen 9 is stopped. Since the stopper 11 is operated in the manner described above, the document can be stopped at the exposure position with the less resistance given to the conveyance belt on the platen by the stopper 11, and further the stopper 11 does not interrupt the movement of the document delivered out from the exposure position.

The numerals 14,15,16 are the first, second, and third document sensors which are provided to the document conveyance path located from the document stack unit 1 to the document delivery unit 13. The numeral 17 is a frame opening sensor which detects whether the frame 18 is opened or not, wherein the frame 18 is provided to the top of the copier main body as can be opened manually around the shaft provided in parallel with the platen surface when a document is set on the platen glass manually.

The rotation speed of each part from the feed roller 6 to the conveyance belt 9 on the platen can be changed into at least two steps. For example, the rotation speed can be change by the motor 19, shown in FIG. 2, such as a D.C. servo-motor which is combined with a speed control device in which a D.C. motor and an encoder or a tachogenerator are used.

The operation of the relay roller 8, the feed roller 6, and the document separating means 7 is conducted in the following way, as shown in FIG. 2. The rotation of the motor 19 is transmitted to the carrier pulley 21 through the motor pulley 20 and the timing belt. Further, the rotation is transmitted from the reduction carrier pulley 22 which is integrally rotated with the carrier pulley 21, to the roller pulley 8A which is integrally formed with the roller 8, and to the input side pulley 24 of the magnetic clutch 23, wherein the rotation is transmitted by a timing belt. Under the condition that the magnetic clutch 23 is turned on, being controlled by the copier control unit, the rotation of the input side pulley 24 is transmitted to the output gear 26 which is integrally formed with the output shaft 25, and transmitted to the gear 27 which engages with the gear 126 and drives the belt 7A of the document separation means 7. Further the rotation is transmitted from the pulley 28 which is integrally rotated with the gear 27, to the roller shaft pulley 6A which is integrally formed with the feed roller 6, wherein the rotation is transmitted by a timing belt. When the document separation roller 7B of the document separation means 7 needs to be rotated counterclockwise, it can be rotated, for example, by an oscillating crank and a ratchet mechanism driven by the belt shaft. The conveyance belt on the platen 9 is moved in such a manner that: the rotation of the above-described carrier pulley 21 is transmitted to the output side pulley 30 when the magnetic clutch 29 controlled by the control unit is turned on; and the rotation is transmitted from the output side pulley 30 to the roller shaft pulley 9AP which is integrally formed with the drive roller 9A to drive the conveyance belt 9 on the platen, wherein the rotation is transmitted by a timing belt.

The delivery rollers 12 can be rotated by the motor 31, which is rotated counterclockwise in FIG. 2 by a control unit, through the motor pulley 32, the belt, and the pulley 12p provided to the shaft of the delivery roller 12. The motor 31 is provided only for delivering out a document which has been conveyed by the conveyance belt 9 on the platen, to the document delivery unit 13 by the delivery roller 12, so that its capacity may be small compared with the motor 19. The related between the rotating speed of the motor pulley 32 and that of the roller shaft pulley 12P may be set so that the conveyance speed of the document delivery roller 12 can be the same as that of the conveyance belt 9 on the platen or can be a little larger, and slippage may occur between the document to be conveyed and the belt 9 while the document is conveyed by both the delivery roller 12 and the conveyance belt 9 on the platen.

The working action of the automatic document feeder of the example will be explained as follows, wherein the automatic document feeder is applied to a copier.

The automatic document feeder is in the automatic document conveyance mode: the frame 18 is closed as illustrated in FIG. 1; the frame position sensor 17 detects that the frame 18 has been closed; a plurality of documents are stacked on the document stack unit 1; the first document detecting sensor 14 detects that the documents are placed on the stack unit 1; and the documents are squeezed by the side position regulating plate 2, so that the document size sensor 4 detects the document size. When the operation start button is pressed in the state of the automatic document conveyance mood described above, the automatic document feeder is operated by the copier control unit as follows.

The feed roller 6 is lowered by a lifting means not illustrated in the drawing so that it comes into contact with the upper surface of a stacked document with pressure. Then, the feed roller 6 is rotated in the direction of an arrow together with the document separation means 7, the relay roller 8, and further the conveyance belt 9 on the platen. Then, the document bumps against the stopper 11 so that the document is set at the exposure position on the platen glass 10. The detail of the above-described process will be explained as follows: the conveyance belt on the platen 9 starts moving when the second document sensor 15 detects the leading edge of the document and the belt 9 is kept moving until a predetermined period of time has passed, wherein the predetermined period of time is determined by the method of a timer or a pulse count; the motor 19 illustrated in FIG. 2 is applied the motor brake when the leading edge of the document has reached the position that is 5 to 10 mm before the stopper, so that the motion of the conveyance belt 9 on the platen is weakened; and the document bumps against the stopper 11 by inertial force and stops. When the document is fed in the way described above, in order to prevent double feeding of document, the feed roller 6 is stopped before the trailing end of the document reaches the document separation means 7, by turning off the magnetic clutch 23 illustrated in FIG. 2, wherein the timing of turning off the magnetic clutch 23 can be determined by the document length information obtained from the second document sensor 15 which detects the leading edge of the document. At the same time, the feed roller 6 is lifted up to the position illustrated by a solid line in FIG. 1.

When the above-described first document is fed, it is not necessary to rotate the delivery out roller 12. However, after the conveyance belt 9 on the platen is started, the delivery out roller 12 is started so that the delivery roller 12 can convey the document sent from the position of the stopper 11 at a speed of the conveyance belt on the platen. The object of this operation is to deliver out a document located on the exposure position by the rotation of the conveyance belt 9 on the platen and the delivery roller 12 without jamming, in the case of that the document has been manually set on the platen beforehand. In this case, the delivery roller 12 is stopped after the trailing end of the document has passed through the delivery roller 12.

The scanning exposure in the direction of a bold arrow is conducted on the document set at the exposure position by the optical scanning system comprising the exposure lamp 33 and the like, wherein the number of the scanning exposure is the same as the required number of copies. In order to improve the productivity, the stroke of the scanning exposure is set according to the document size information.

While the above-described scanning exposure is conducted, the feed roller 6, the lifting means of the feed roller, the document separation means 7, the relay roller 8, are driven so that the following document can be conveyed to an appropriate waiting position in the interval from the relay roller 8 to the entrance of the conveyance belt 9 on the platen. While the above-described process is conducted, the motor 19 illustrated in FIG. 2 is rotated. However, the magnetic clutch 29 is turned off so that the conveyance belt 9 on the platen can not be rotated. At this time, the rotating speed of the motor 19 is made slower than the rotating speed at which a document is conveyed to the exposure position so that double feeding of document can be positively avoided. Even the motor speed is reduced as described above, the productivity of a copier is not reduced. The waiting position of the following document is determined by the interval between the time when the second document sensor 15 detects the leading edge of a document and the time when the feed roller 6 is stopped. It is preferable that the leading edge of the following document is made close to the trailing end of the document placed on the platen glass in order to improve the productivity of a copier. When the feed roller 6 is stopped, the trailing end of the document which is kept waiting is still located at the feed roller 6 and so the feed roller 6 is not returned to the position illustrated by a solid line.

When the document located at the exposure position has been exposed, the optical scanning system is returned to the position illustrated in the drawing and at the same time the feeding means located between the feed roller 6 and the delivery out roller 12 are rotated and the document on the platen glass 10 is delivered onto the document delivery unit 13. At the same moment, the leading edge of the following document is bumped against the stopper 11 to set the document at the exposure position on the platen glass. In this case, when the interval between the leading edge of the document kept waiting and the trailing end of the document located on the platen glass, is made shorter than the interval between the stopper 11 with which the document comes into contact and the nip position of the document delivery rollers 12, in order to increase the productivity of the copier, the trailing part of the previous document is remained between the document delivery out rollers 12 and the stopper 11 when the following document is conveyed onto the platen and the conveyance belt 9 on the platen is stopped. However, since the delivery roller 12 is rotated by the motor 31, the previous document is delivered onto the document delivery out unit 13 even after the conveyance belt 9 on the platen has been stopped. The delivery roller 12 is stopped after the trailing end of the document has passed through the roller 12.

The following operations are repeated until the first document sensor 14 detects that all the documents have been processed: scanning exposure is conducted on the document conveyed onto the platen glass; during the scanning exposure, a document is conveyed from the document stack unit 1 to the waiting position; and right after the scanning exposure, the document located on the platen is delivered out and the following document located at the waiting position is sent to the exposure position. A series of operations of the automatic document feeder are completed in such a manner that: when the last document by which the first document sensor 14 detects that there is left no document on the document stack unit, is exposed at the exposure position, the operations to feed the following document are not conducted; after the last document is exposed and when the last document is sent out from the platen glass 10, the motor 19 is stopped; and when the last document is delivered out onto the document delivery unit 13, the motor 31 is stopped.

The document information obtained by the third document sensor 16 is used for counting the number of the documents, for obtaining the signal to stop the motor 19 and the motor 31, and for detecting the document which passes through the stopper 11.

A series of copy operations of the copier are completed when the optical scanning system is returned to the position illustrated by a solid line in the drawing, and the last copied paper of the preset number of copies is discharged from the copier.

The automatic document feeder of the present invention can be used not only for a copier but also for a document reader and similar apparatuses. It should be understood that the conveyance means on the platen is not limited to the conveyance means of a belt type and that there is also no need to be the type in which a document is conveyed to the waiting position beforehand.

The automatic document feeder of the present invention is characterized in that: the interval between a document sent out and a document sent in is made short in order to quickly replace the document on the platen glass; as a result, even when the following document has been conveyed onto the platen glass by the conveyance means on the platen, the trailing end of the previous document has just been released from the conveyance means on the platen and the document has not been discharged to the delivery unit completely yet; the document is discharged without any problems to the delivery unit by the delivery out means which is kept rotating, so that the total processing time can be reduced, and the consumption of electricity and the wear of the conveyance means can be decreased.

Figure 3:
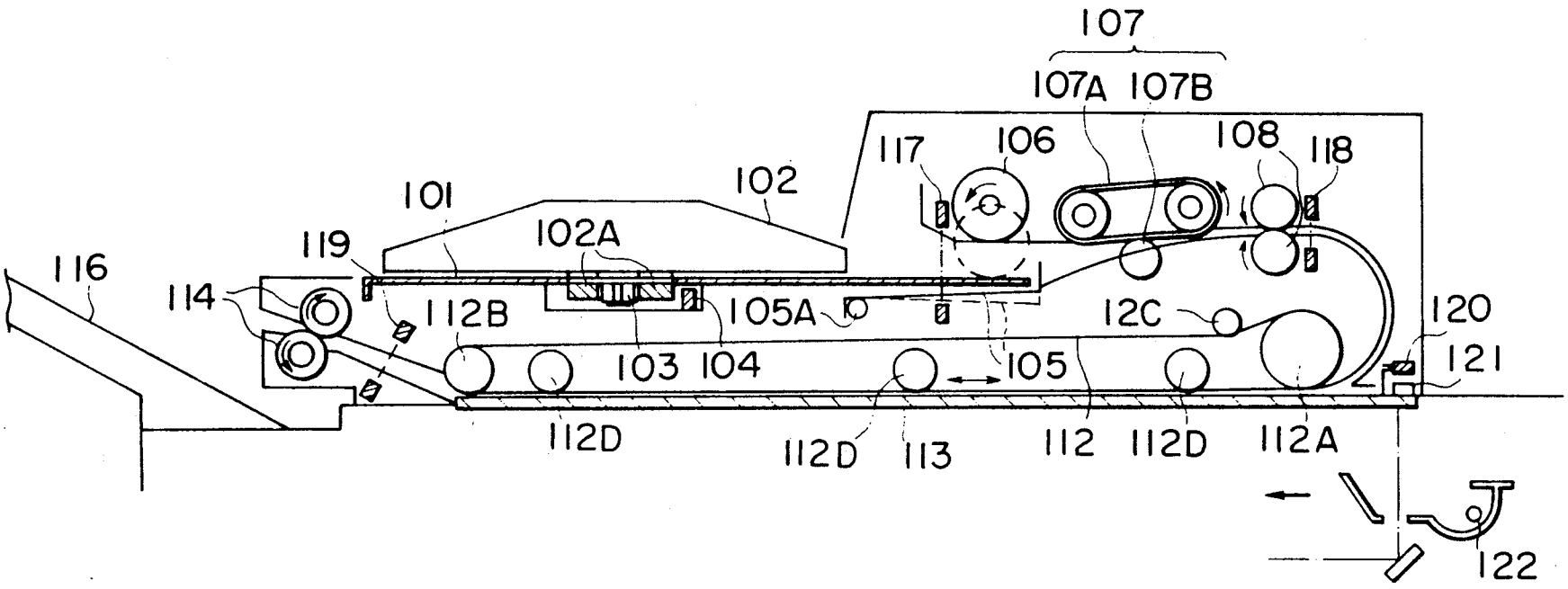
FIG. 3 is a sectional side view of the main portion of the automatic document feeder of the present invention to attain the second object of the invention.
Figure 4:
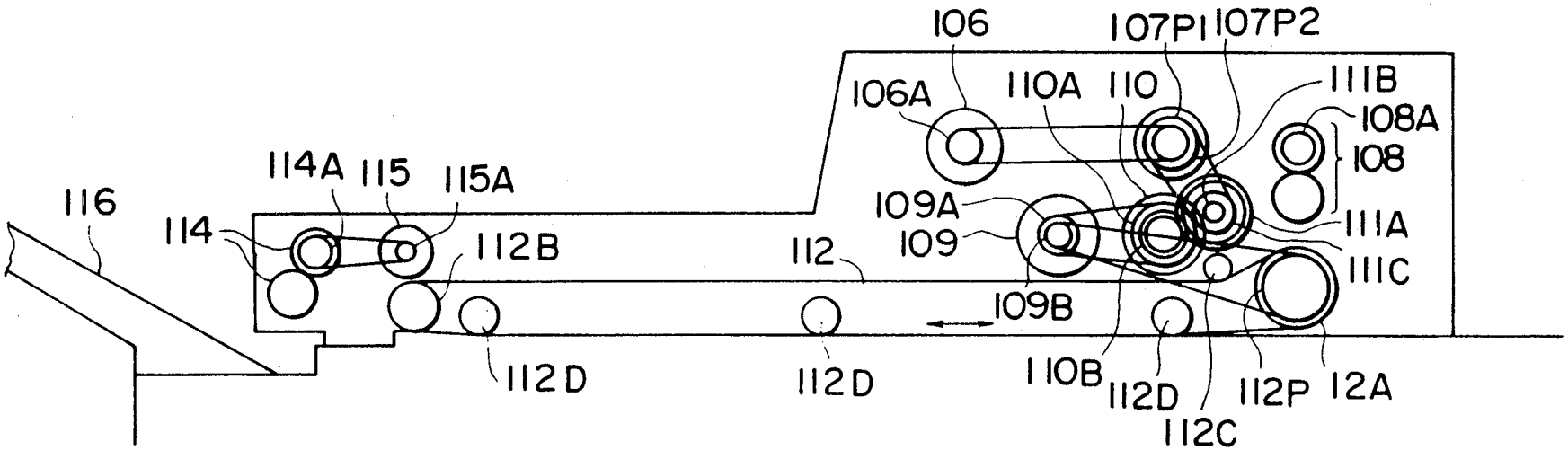
FIG. 4 is a perspective view of the drive mechanism of the automatic document feeder of the present invention to attain the second object of the invention.

FIG. 3 is a schematic side view which shows the composition of an example of the automatic document feeder to accomplish the second object of the present invention. FIG. 4 is a schematic drawing which shows the drive mechanism of an example of the automatic document feeder to accomplish the second object of the present invention.

In FIG. 3, the numeral 101 is a document stack unit, and the numeral 102 is a pair of side position regulating plates which is composed in such a manner that: a pair of racks 102A are provided to the lower portion of the document stack unit 101; and both racks are engaged through the pinion 103 so that the plates can be symmetrically moved. The numeral 104 is a document size sensor which detects the information about the document size by detecting the position of the rack 102A. The numeral 105 is a document-leading-edge-regulating-plate which arranges the leading edge of the documents stacked on the document stack unit 101. The numeral 106 is a document feed roller which comes into contact with the upper surface of the document stacked on the document stack unit 101, and which is rotated in the direction of an arrow so that the uppermost document can be sent out by the frictional force. When the feed-out roller 106 is displaced its position by a lifting means not illustrated in the drawing from the position illustrated by a solid line to the position illustrated by a broken line, the document-leading-edge-regulating-plate 105 is rotated around the supporting shaft 105A by a drive means not illustrated in the drawing and also displaced from the position illustrated by a solid line to the position illustrated by a broken line so that the document leading edge position regulating plate 105 does not obstruct document feeding.

The numeral 107 is a document separating means comprising the conveyance belt 107A which is rotated in the direction of an arrow and the separation roller 107B which is stationary or rotated counterclockwise at a slow speed, wherein the separation roller 107B comes into contact with the belt surface with light pressure. The numeral 108 is a pair of feed-in rollers which further convey the document sent by the separation means 107. The document feed conveyance means is composed of the feed-out roller 106, the document separation means 107, and the feed-in roller 108.

As shown in FIG. 4, the feed conveyance means is driven in such a manner that: the rotation of the reversible motor 109 is transmitted to the input side pulley 110A of the magnetic clutch 110, which is also used as a one-way clutch, through the motor pulley 109A and a timing belt; when the magnetic clutch 110 is turned on, only clockwise rotation is transmitted to the output side gear 110B; the carrier gear 111A which engages with the output side gear 110B, and the carrier pulleys 111B,111C which are integrally formed with the carrier gear 111A, are rotated counterclockwise; the rotation of the carrier pulleys 111B,111C is transmitted through each timing belt to the pulley 108A integrally formed with the feed-in roller 108, and to the pulley 107P1 which is integrally formed with a drive roller of the frictional feed belt 107A of the document separation means 107; and further the rotation is transmitted from the pulley 107P2 which is integrally formed with the pulley 107P1, to the pulley 106A which is integrally formed with the feed-out roller 106 through a timing belt.

The numeral 112 is a conveyance belt of the conveyance means on the platen. The numerals 112A and 112B are a drive roller and an idle roller by which the conveyance belt 112 is stretched. The numeral 112C is a tension roller of the conveyance belt 112. The numeral 112D are press rollers which press the conveyance belt 112 against the upper surface of the platen glass 113 with pressure. The conveyance belt 112 is rotated by the drive roller 112A which is integrally formed with the pulley 112P, wherein the drive force of the reversible motor 109 is transmitted from the motor pulley 109B to the pulley 112P through a timing belt.

The numeral 114 are delivery rollers of the delivery out means which deliver out the document conveyed by the conveyance belt 112, onto the document delivery unit 116. The delivery roller 114 is rotated by the pulley 114A which is integrally formed with the delivery roller 114, wherein the clockwise rotation of the motor 115 is transmitted from the motor pulley 115A to the pulley 114A through a timing belt.

The numerals 117 to 120 are document sensors. The document sensor 117 detects whether documents are placed on the document stack unit 101 or not. The document sensor 118 detects the sending out of a document by the document conveyance means. The document sensor 119 detects a document sent out from the upper surface of the platen glass 113. The document sensor 120 detects the trailing end of a document which has reached the stopper 121.

The working actions of the automatic document feeder, the composition of which has been described above, will be explained as follows, wherein the explanations will be conducted under the condition that the automatic document feeder is applied to a copier.

Documents are placed on the document stack unit 101 so that the leading edges of the documents come into contact with the leading edge regulating plate 105, and the sides of the documents are squeezed by the side position regulating plates 102. Then, the document size information is given to a control unit not illustrated in the drawing by the document size sensor 104. In the automatic document conveyance mode described above, when a copy button is pressed, the control unit of the copier controls the automatic document feeder as follows.

The feed-out roller 106 is lowered by a lifting means and comes into contact with the upper surface of the documents placed on the document stack unit 101. At the same time, the leading edge regulating plate 105 is moved to the withdrawal position so that it does not interfere with the document conveyance. Then, the reversible motor 109 is rotated clockwise and the magnetic clutch 110 is turned on. According to the operations described above, the uppermost document of the document stack located on the document stack unit 101, is conveyed to the conveyance belt 112 of the conveyance means on the platen by the feed-in conveyance means which is composed of the feed-out roller 106, the document separation means 107, and the feed-in roller 108. When the first document has been released from the feed-out roller 106, the following uppermost document is conveyed out by the feed-out roller 106 successively.

The magnetic clutch 110 is turned off after the trailing end of the first document and the leading edge of the second document have passed through the position of the feed-in roller 108 and before they reach the conveyance belt 112. Sine the magnetic clutch 220 is turned off, the second document is kept waiting at the waiting position. The time when the magnetic clutch is turned off, is determined in such a manner that when the leading edge or the trailing end of the first document or the leading edge of the second document has been detected by the document sensor 118, a timer operation or pulse counting is started so that the time to turn off the magnetic clutch can be determined. When the time is determined in the way explained above, the following factors are concerned with the determination: the document conveyance speed, the distance between the feed-in roller 108 and the conveyance belt 112, if necessary the distance between the feed-out roller 106 and the regulating position of the leading edge position regulating plate 105, and the document length in the direction of conveyance.

In order to detect the trailing end of the previous document and the leading edge of the following document by the document sensor 118, the conveyance speed of the feed-out roller 106 and that of the document separation means 107 are set slower than the conveyance speed of the feed-in roller 108 so that the overlapping portion of the document which corresponds to the distance between the feed-out roller and the regulating position of the leading edge regulating plate 105, can be canceled before the trailing end of the previous document reaches the feed-in roller 108. When the document sensor 118 is installed between the document separation means 107 and the feed-in roller 108, the conveyance speed of the feed-out roller 106 and that of the document separation means 107 must be set slower than that of the feed-in roller 118 so that the overlapping portion can be canceled before the trailing end of the previous document reaches the position of the document sensor 118. In the way described above, the time to turn off the magnetic clutch 110 and that to reverse the reversible motor 109, can be precisely determined, which will be described later.

Even after the magnetic clutch 110 is turned off, the reversible motor 109 is kept rotating clockwise, and the first document is perfectly conveyed onto the platen glass 113 by the conveyance belt 112. Then, the reversible motor 109 is reversely rotated, and the first document is moved back to the right end on the platen glass 113 by the conveyance belt 112. The time when the motor 109 is reversely rotated is determined in such a manner that: when the document sensor 118 detects the leading edge or the trailing end of the first document, a timer operation or pulse counting is started so that the time to reverse the motor 109 can be determined.

When the trailing edge of a document which is conveyed to the right, is detected by the document sensor 120, the counterclockwise rotation of the motor 109 is stopped. Therefore, the right edge of the first document comes into contact with the stopper 121 and the document is set at the exposure position. Then, the optical scanning system composed of the exposure lamp 122 and the like, is transferred in the direction of an arrow and the scanning exposure is conducted by the number of times which is the same as the required number of copy, wherein the image on the first document is projected on the photoreceptor drum by the scanning exposure. In this way, the copies of the first document, the number of which is designated, can be obtained.

When the scanning exposure has been completed, the optical scanning system is returned to the position illustrated in the drawing, and the motor 109 is rotated clockwise and at the same time the magnetic clutch 110 is turned on. Since the above-described operations are conducted, the first document located on the platen 113 is conveyed to the left and transferred from the platen 113 to the delivery roller 114, and at the same time the second document located at the waiting position is conveyed to the conveyance belt 112. When the first document is detected by the document sensor 119, the motor 115 is rotated and the delivery roller 114 is rotated in the direction of an arrow. Accordingly, the first document delivered from the platen glass 113 is discharged to the document delivery unit 116. The rotation of the motor 115 is stopped after the first document is discharged from the delivery roller 114. The time to stop the motor 115 is determined by a timer operation or pulse counting which is started when the document sensor 119 detects the leading edge or the trailing end of the first document.

When the second document is conveyed to the exposure position by the conveyance belt 112, the motor 109 is stopped in the same way as the first document. Before the motor 109 is stopped, the magnetic clutch 110 is turned off and the third document is kept waiting at the waiting position in the same way as the second document.

In the present invention, the time when the magnetic clutch 110 is turned off, in other words the waiting position of the second or the following document is determined in such a manner that: the time when the motor 109 is stopped after the second or the following document is conveyed onto the exposure position, is determined so that the trailing end of the previous document can be located at the position between the delivery roller 114 and the conveyance belt 112, and so that the position can be as close as possible to the conveyance belt 112. When the waiting position is set in the way described above, the time necessary to convey the second or the following document from the waiting position to the exposure position can be reduced, and as a result the total copying time can be reduced.

In the same way as described above, scanning exposure is conducted on the second document conveyed onto the exposure position, and after that the second document is delivered out from the exposure position to the document delivery unit 16, and then the third document is conveyed onto the exposure position. The same operations are repeated in such a manner that: when the document sensor 117 detects that there is left no document on the document stack unit, and when the last document relating to it, is delivered from the exposure position, the motor 109 is rotated clockwise; the magnetic clutch 110 is not turned on; when the trailing end of the last document is detected by the document sensor 119, the motor 109 is stopped; and when the trailing end of the last document is released from the delivery roller 114, the motor 115 is stopped so that a series of operations of the automatic document feeder is completed.

The automatic document feeder of the present invention is not limited to the above-described example, and it may be composed in such a manner that: the feed-in conveyance means can be composed of only a feed-out roller which conveys a document from the document stack unit; the second or the following document is conveyed onto the exposure position by the feed-out roller and the conveyance means on the platen; and the document reaches the document exposure position when the trailing end of the previous document is located between the delivery conveyance means and the conveyance means on the platen. Further, the document feeder of the present invention may be composed in such a manner that: the conveyance means on the plate and document delivery means are driven by the same motor in the same way as the case of the feed-in conveyance means and the conveyance means on the platen; and the document sensor of the exposure position or the stopper is omitted and the time to stop a document on the exposure position is determined according to a timer operating or pulse counting based on the results of detection by the document sensor placed at the entrance of the conveyance means on the platen. Further, the automatic document feeder of the present invention may be composed in such a manner that: the position where the trailing end of the document conveyed by the conveyance means on the platen falls on the platen, is the exposure position, and the conveyance means on the platen is not reversed.

In the automatic document feeder of the present invention, when a stopper is provided to the exposure position, the stopper can be made fixed and it is not necessary to withdraw the stopper during the operation, and further a plurality of documents can be processed quickly.

What is claimed is:

1. An apparatus for feeding a plurality of documents, comprising:

a platen on which a document is subject to a copying operation, the platen having a first side from which the document is fed and a second side from which the document is delivered from the platen, the second side being opposite to the first side along a feeding path;

means for feeding the document onto the platen at the first side;

means for delivering the document form the plate at the second side;

means for conveying the document to a standard stop position on the platen and for further conveying the document from the standard stop position to the delivering means, herein the distance along the path between a start position for a document to be fed onto the platen and the standard stop position is longer than the distance along the path between a leading edge of the document stopped at the standard stop position and the delivering means, and shorter than the distance along the path between a trailing edge of the document stopped at the standard stop position and the delivering means; and means for controlling the feeding means and the conveying means to simultaneously convey a preceding document at the standard stop position and feed a succeeding document to the standard stop position, the delivering means being independently operable from the conveying means so that a leading edge of the preceding document which has been subjected to the copy operation reaches the delivering means when the succeeding document is stopped at the standard stop position.

2. The apparatus of claim 1, wherein the controlling means comprises means for controlling the operation of the feeding means to define the start position at a location where the leading end of the succeeding document is located between the feeding means and the conveying means.

3. The apparatus of claim 2, wherein the operation controlling means provides that the start position is on a document tray for stacking multiple documents.

4. The apparatus of claim 1, wherein the feeding means comprises means for moving a succeeding document to a waiting position coincident with the start position during a period in which a preceding document is subjected to a copy operation.

5. The apparatus of claim 1, wherein the controlling means includes a sensor to determine a waiting position coincident with the start position, the sensor being proximate the feeding means.

6. The apparatus of claim 1, wherein the controlling means further comprises a stopping means capable of being moved into and out of the feed path along the platen for stopping a succeeding document.

7. The apparatus of claim 1, wherein the apparatus further includes means for copying a document including exposure means for exposing a document, the exposure means moving to a home position after exposure, and wherein the controlling means includes means for controlling the simultaneous conveyance so that it occurs during a period when the exposure means has completed exposing the document and when the exposure means returns to the home position.

8. The apparatus of claim 1, wherein the delivering means includes means for stopping the delivery when the trailing edge of the preceding document has passed through the delivering means after the conveying means has been controlled to stop.

9. The apparatus of claim 1, wherein the controlling means includes means for controlling the conveying means and the delivering means so that the succeeding document is stopped at the standard stop position while the delivering means continues the delivery for the preceding document.

* * * * *

UNITED STATES PATENT AND TRADEMARK OFFICE

CERTIFICATE OF CORRECTION

PATENT NO. : 5,120,039

DATED : June 09, 1992

INVENTOR(S) : Yasushi Yamada

It is certified that error appears in the above-identified patent and that said Letters Patent is hereby corrected as shown below:

Abstract, line 10, change "delivery" to --delivery--.

Claim 1, column 13, line 6, change "form" to --from--.

Claim 1, column 13, line 6, change "plate" to --platen--.

Claim 1, column 13, line 29, change "reaches" to --has reached--.

Signed and Sealed this

Fifth Day of October, 1993

Bruce Lehman

*Attest:*

BRUCE LEHMAN

*Attesting Officer*

*Commissioner of Patents and Trademarks*